United States Patent [19]

Stover

[11] 4,258,954

[45] Mar. 31, 1981

[54] PROCESS FOR THE SOLUTION MINING OF A MINERAL

[75] Inventor: Dennis E. Stover, Plano, Tex.

[73] Assignee: Atlantic Richfield Company, Los Angeles, Calif.

[21] Appl. No.: 926,597

[22] Filed: Jul. 20, 1978

Related U.S. Application Data

[63] Continuation of Ser. No. 734,314, Oct. 20, 1976.

[51] Int. Cl.[3] ..... E21B 43/28; E21C 41/14

[52] U.S. Cl. ..... 299/4

[58] Field of Search ..... 299/4, 5

[56] References Cited

U.S. PATENT DOCUMENTS

| | | | |
|---|---|---|---|
| 2,896,930 | 7/1959 | Menke et al. | 299/5 |
| 3,574,599 | 4/1971 | Ortloff et al. | 299/4 |
| 3,713,698 | 1/1973 | Rhoades | 299/4 |
| 3,860,289 | 1/1975 | Learmont | 299/4 |
| 3,915,499 | 10/1975 | Mallon et al. | 299/4 |

*Primary Examiner*—Ernest R. Purser

*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of the mineral from a mature subterranean formation via solution mining. The improvement comprises increasing the flow rate of leachant into the formation by at least a factor of two.

7 Claims, 2 Drawing Figures

PROCESS FOR THE SOLUTION MINING OF A MINERAL

This is a continuation of application Ser. No. 734,314, filed 10/20/76.

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well-known, such as ion exchange.

The process of the present invention is particularly suitable for the leaching of uranium; however, my invention is not so limited. The following description of the present invention will be applied to uranium leaching; however, it is apparent that it is applicable to leaching other mineral values such as copper, nickel, molybdenum, rhenium and selenium where similar problems are encountered.

Although acid leaching solutions can be used in some formations, only alkaline leaching solutions can be used where the particular formation contains significant quantities of acid-consuming gangue.

It is well-known that to increase the recovery of uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium and the second the dissolution of the oxidized uranium in the solution.

It has been found that during the early stages (when the ore body is in a reduced state) of a leach operation utilizing alkaline solutions of ammonium carbonate, sodium carbonate, potassium carbonate and their respective bicarbonates in conjunction with the typical oxidants of air, oxygen, and hydrogen peroxide, some of the uranium that is oxidized and dissolved near the injection well is reduced and precipitated in the more reduced regions of the formation between the injection well and the production well. Through this action the oxidized region of the formation is depleted of uranium and the reduced region of the formation becomes enriched as the leach operation continues. Therefore, this process of oxidation and dissolution followed by reduction and precipitation continues as the formation becomes progressively oxidized, whereby the region in the immediate vicinity of the production well becomes progressively enriched toward maturity. The uranium is depleted from a zone in the formation far more quickly than the oxidant consuming gangue species present therein. Therefore, as the uranium oxidation front recedes from the injection well, the available oxidant for oxidation of the uranium decreases. This causes a slower dissolution of uranium and a lower maximum concentration of uranium solution as the depleted zone moves through the formation. Therefore, there is needed a method whereby a mature formation containing a mineral such as uranium can be leached with a leach solution without being accompanied by excessive losses of oxidant and a diminishing rate of mineral recovery.

Therefore, it is an object of the present invention to provide an improved method for the solution mining of a mineral from a subterranean formation, applicable generally to minerals requiring oxidation to be leached and to both acid and alkaline leach solutions.

A further object of the present invention is to provide an improved method for the solution mining of uranium.

It is an additional objective of the present invention to provide an improved method for the solution mining of uranium from subterranean deposits which substantially maintains its initial rate of recovery in the later stages of the operation without the needless waste of oxidant.

Figure 1:
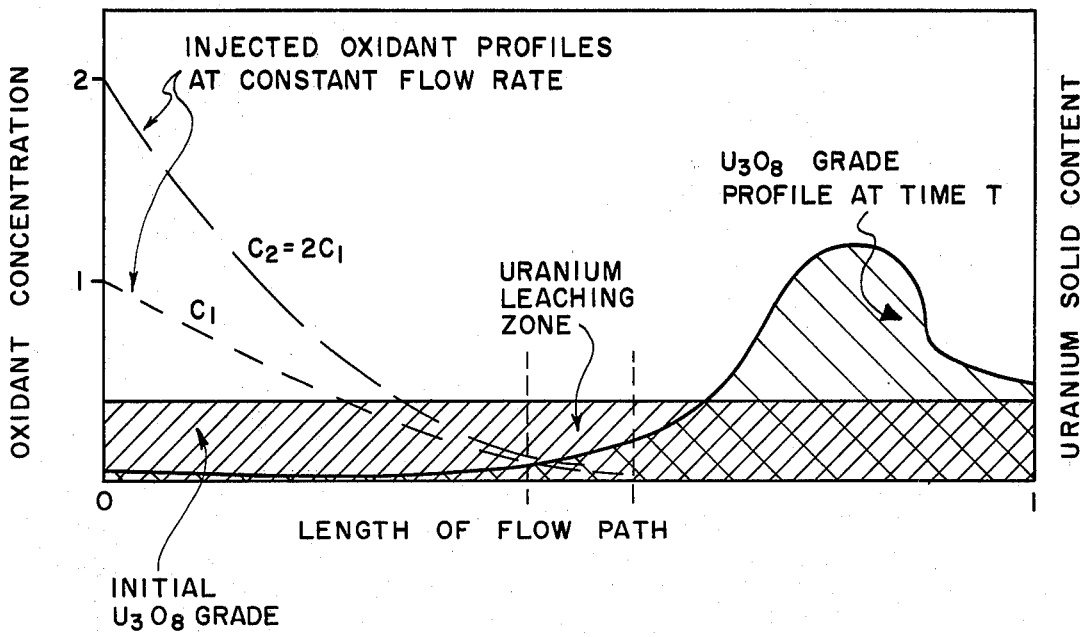
FIG. 1 is a graphical illustration of oxident concentration in a subterranean deposit between an injection well and production well when the injected oxident is at constant flow rate.

Recent studies have shown that the uranium oxidation and dissolution process is accompanied by a reprecipitation process such that the solid uranium is dissolved near the injection well and partially redeposited along the flow path toward the production well. As shown in FIG. 1, the distribution of the solid uranium between the wells is drastically altered during the course of the in situ leaching such that it concentrates near the producing well late in its operating life.

As this dissolution and redeposition process proceeds, the primary uranium leaching or dissolution zone gradually travels away from the injection well toward the producing well and the flow path for the oxidant to contact the uranium increases. If the oxidant was specific for uranium, the impact of this increasing flow path would be limited to dispersion effects. However, it is clear that conventional oxidants such as oxygen and hydrogen peroxide are not specific for uranium but oxidize other species present in the host formation. These gangue reactions consume the bulk of the injected oxidant (70—80%) and continue to occur in the regions from which uranium has been leached (the barren zone). Thus, the oxidant available in the uranium leaching zone is significantly less than the injected concentration.

It has been found that the uranium dissolution rate is a function of the available oxidant concentration. My studies demonstrate that an increased uranium production can be achieved by increasing the available oxidant concentration in the leaching zone.

The rate of uranium oxidation and, hence, production in a mature pattern is, indeed, limited by the oxidant concentration in the leaching zone. The fluid flow rate can increase the injected oxidant mass per unit time to maximize the increase in the oxidant concentration at the uranium leaching zone.

The gangue reaction rates as well as the uranium dissolution rate are enhanced by an increased oxidant concentration. Data indicate that sulfate generating reaction rates in the presence of an oxidant are significantly slower than the uranium dissolution rate, and decrease with time to what may be an oxidant diffusion controlled limit. The use of an increased injection oxidant concentration as a means of increasing the leaching zone concentration is inefficient in a mature well. A significant portion of such an increase is consumed in the barren zone by the accelerated gangue reactions. An example of this situation is shown in FIG. 1. A doubling of the injected oxidant concentration resulted in only a slight increase in the corresponding concentration at the leaching zone, which created a short-lived increase or plateau in the uranium concentration of the produced fluid. The method of increasing the injected oxidant concentration is severely limited by the nonselective nature of the oxidant and the fact that oxidant concentration is a driving force for some if not all gangue reactions.

Figure 2:
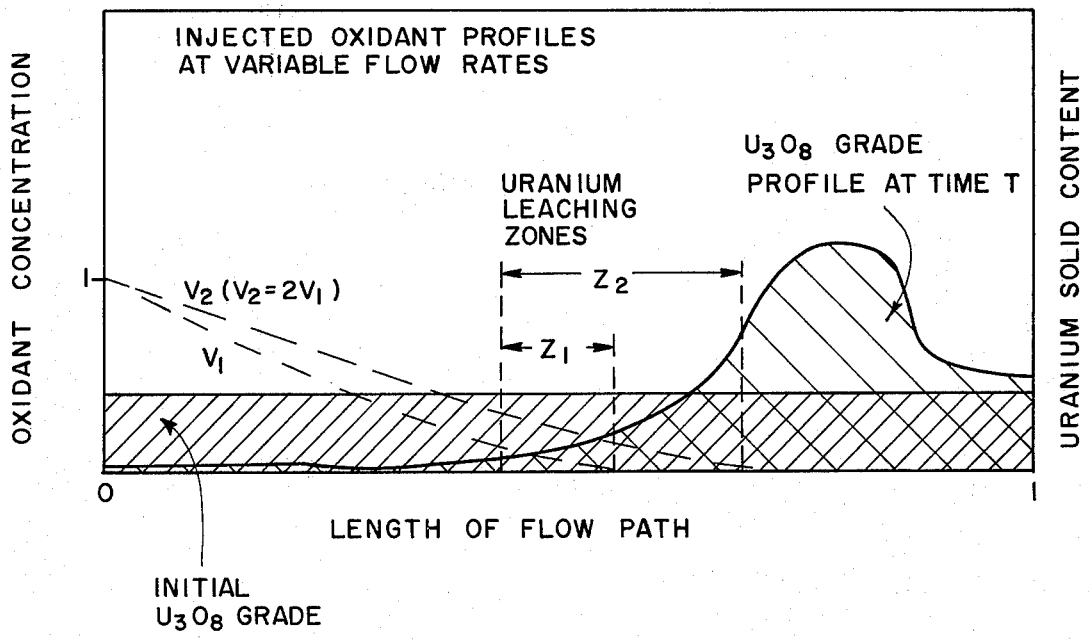
FIG. 2 is a graphical illustration as shown in FIG. 1, when oxident is injected at variable flow rates.

This latter limitation is significantly reduced by increasing the flow rate to increase the leaching zone oxidant supply. In the vicinity of the injection well, the driving force, i.e., oxidant concentration, for the gangue reactions is essentially the same as the baseline conditions. However, the mass of oxidant per unit time which passes through this barren zone is increased. The gangue reactions are slow (diffusion control), the fractional oxidant consumption at this mass rate is significantly less than for the baseline case. Hence, the decline in the oxidant concentration is diminished. This effect is illustrated in FIG. 2 for a doubling of the flow rate. Because a larger fraction of the oxidant penetrates the barren zone at a correspondingly larger concentration, the gangue reaction driving force will be enhanced at positions removed from the injection well. However, because of the increased oxidant mass rate, the net reduction in the oxidant concentration is less than that induced by a comparable increase in the injected oxidant concentration.

As shown in FIG. 2, the cumulative effect of this increased oxidant concentration is that more oxidant reaches the uranium leaching zone (mass oxidant per mass uranium) and that more uranium surfaces are now included in this zone. If the average uranium dissolution rate in the zone is given as $$\bar{r}_{uo2}=k\,\bar{C}_{o2}^{\frac{1}{2}}S_u$$

where $\bar{C}_{o2}$ is the average oxidant concentration across the leaching zone and $S_u$ is the total uranium surface area within the zone, the dual benefits of the increased flow rate are readily seen: the average oxidant concentration and the uranium surface area within the zone are increased, both of which increase the average uranium dissolution rate. Thus, the net uranium production, mass per unit time, is increased.

The fact that much of the available uranium surfaces were formed by redeposition during the leaching process results in their being readily accessible for the oxidant and easily oxidized.

Experimental support for the present invention was demonstrated in a laboratory flow test in which the flow rate was increased from approximately 1.7 to 3.4 pore volumes per day. Approximately 95 percent of the uranium had been recovered and its concentration in solution was steadily declining. The flow rate doubling resulted in a suspension of the decline at a concentration of 45 mg/l which was sustained for ten pore volumes. This corresponded to a uranium production level, mg/day, which was twice that observed just prior to the flow rate increase.

Similar tests, with comparable oxygen concentration increases, displayed uranium concentration increases on plateaus of significantly less duration. These results are consistent with the implications of FIG. 1.

Therefore, the utilization of the present invention, the recovery of uranium via in situ leaching processes, can be enhanced significantly by most effectively using the available oxidant to oxidize uranium rather than gangue.

Having thus described my invention, I claim:

1. An improved method for the solution mining of a mineral from a subterranean formation containing same in which an injection and production well are drilled and completed within said formation, leach solution and an oxidant are injected through said injection well into said formation to dissolve said mineral into said solution, and said solution containing said dissolved mineral is recovered via said production well, wherein the improvement comprises increasing the flow rate of said oxidant and leach solution by at least a factor of two when the concentration of said dissolved mineral in said recovered solution begins to decline.

2. The improvement of claim 1 wherein said mineral is selected from the group consisting of copper, nickel, molybdenum, rhenium, selenium and uranium.

3. The improvement of claim 1 wherein said leach solution in acidic in nature.

4. The improvement of claim 3 wherein said acid leach solution is selected from the group consisting of hydrochloric and sulfuric acid.

5. The improvement of claim 1 wherein said leach solution is alkaline in nature.

6. The improvement of claim 5 wherein said alkaline leach solution is an aqueous solution of one or more salts selected from the group consisting of ammonium carbonate, sodium carbonate, potassium carbonate and their respective bicarbonates.

7. The improvement of claim 1 wherein said oxidant is selected from the group consisting of air, oxygen and hydrogen peroxide.

* * * * *